US005552796A

United States Patent [19]

Diamond

[11] Patent Number: 5,552,796

[45] Date of Patent: Sep. 3, 1996

[54] VHF, UHF ANTENNA

[76] Inventor: Maurice Diamond, 74 Deerfield Rd., Sharon, Mass. 02067

[21] Appl. No.: 322,262

[22] Filed: Oct. 13, 1994

[51] Int. Cl.[6] ..... H01Q 11/12

[52] U.S. Cl. ..... 343/742; 343/867; 343/882

[58] Field of Search ..... 343/729, 742, 343/867, 895, 882, 792

[56] References Cited

U.S. PATENT DOCUMENTS

| | | | |
|---|---|---|---|
| 3,096,518 | 7/1963 | Tiikkainen | 343/742 |
| 3,387,101 | 6/1968 | Nienaber | 343/882 |
| 3,478,361 | 11/1969 | Middlemark | 343/742 |
| 3,932,873 | 10/1995 | Garcia | 343/792 |

FOREIGN PATENT DOCUMENTS

| | | | |
|---|---|---|---|
| 938921 | 2/1956 | Germany | 343/742 |
| 3100313 | 8/1982 | Germany | 343/742 |

*Primary Examiner*—Donald T. Hajec
*Assistant Examiner*—Tho Phan
*Attorney, Agent, or Firm*—Wolf, Greenfield & Sacks, P.C.

[57] ABSTRACT

An antenna for receiving UHF and VHF TV frequency signals provides a good impedance match and a wide frequency band of operation to the TV set. The antenna includes a telescoping cylindrical monopole antenna element rotatably mounted to a support structure and a multi-turn helical antenna element, each turn being rotatably mounted to the support structure. A first lead, at a first end of the transmission line, is coupled to the telescoping monopole antenna element and a second lead, of the twin-lead transmission line, is coupled to the helical antenna element. A second end of the twin-lead transmission can be coupled to a TV set for clear reception of the VHF and UHF TV signals.

12 Claims, 2 Drawing Sheets

VHF, UHF ANTENNA

FIELD OF THE INVENTION

This invention relates to an antenna for receiving signals in a VHF, UHF frequency band of operation. In particular, the invention relates to a combination of a monopole element and a multi-turn helix.

BACKGROUND OF THE INVENTION

It is known in the prior art that the Federal Communications Commission (FCC) has allocated frequency channels, each having a 6-MHz width, for commercial television. Channels 2 through 13 are known as the very high frequency (VHF) channels and span a frequency range of 54–216 MHz. Channels 14–83 are known as the ultrahigh-frequency (UHF) band and span the frequency range of 472–890 MHz.

As is known in the prior art, a TV receiving antenna should have sufficient gain and present a good impedance match in order to deliver a TV signal to a transmission line and subsequently to a TV with a clear picture and sound. The TV receiving antenna should provide these properties over all TV channels of interest, more particularly the complete 54–890 MHz frequency range. Such TV receiving antennas typically fall into two categories, indoor antennas and outdoor antennas. The present discussion is limited to indoor antennas.

The most common configuration of an indoor antenna consist of two antennas, one for receiving all VHF channels and one for receiving all UHF channels. The most popular indoor VHF antennas are extendable monopole and dipole telescoping cods (rabbit-ear antennas). A disadvantage to these antennas is that they must be adjusted in length and oriented for best signal strength and to minimize "ghost" images for each channel to be received. Another disadvantage to these antennas is that they are large, each rod particularly on the order of a quarterwave length of the operating frequency band. The two rods of the dipole antenna thereby make up a half wavelength dipole antenna. Thus, a disadvantage of the prior art VHF antennas is that they are extremely burdensome to operate and take up substantial space.

There are also known in the prior art, several configurations of indoor UHF antennas, including a circular loop and a triangular dipole. A problem with the circular loop and the triangular-dipole antennas are that they have low gain. In addition, they also have the problem that they have to be adjusted to minimize "ghost" images for each TV channel to be received.

The single turn circular-loop antenna is a popular UHF antenna primarily because of its low cost. The single-turn loop is a resonant structure, in which the entire UHF frequency band of operation is possible by using a 20.3 centimeter diameter single loop construction such that the circumference of the loop varies across the frequency operation band from a wavelength at 470 MHz to 1.7 wavelengths at 806 mHz, The single-loop antenna has a bidirectional antenna pattern with a maximum directivity along the loop axis. A single loop oriented in a vertical manner and fed at the bottom is thus horizontally polarized. A problem with the single loop antenna is that the input resistance and reactance, respectively, of the single-turn circular loop varies across the frequency band of interest. Consequently, a measured voltage standing wave ratio (VSWR) while close to one near the center of the band, increases to approximately 4.0 at both ends of the frequency band. Thus, there is a significant degradation in performance at the ends of the frequency band of operation.

The aforementioned rabbit-ear antennas are typically available with either a 75- or a 300-ohm impedance. The single-loop UHF antenna is most commonly designed with a balanced 300-ohm impedance. Thus, a popular VHF-UHF combination antenna consists of a continuation of the VHF rabbit-ear dipole antenna and the UHF single-loop antenna mounted on a fixture containing a switchable impedance-matching network. As discussed above, the problem with such an antenna is its size and its cumbersomeness of use.

Accordingly, the present invention is directed to solving the cumbersome operation and size problems associated with the prior art antennas. In addition, the present invention is directed to solving the performance problems associated with the prior art antennas.

SUMMARY OF THE INVENTION

The invention is directed to an antenna for receiving UHF and VHF frequency signals for use in connection with a television set including a monopole antenna element rotatably mounted to a support structure and coupled to a first lead of a twin-lead transmission line and an N-turn helix element, wherein each turn of N-turn helix is rotatably mounted to the support structure, coupled to a second lead of the twin-lead transmission line. A distal end of the twin-lead transmission line is to be coupled to a TV set for reception of the UHF and VHF TV signals.

With this arrangement the UHF and VHF TV signals can be received, with minimum adjustment of the telescoping rod and helix antenna elements and with minimum "ghosting" images of the TV signals. In addition, with this arrangement, the antenna can be mounted on top of a television set or in close proximity to a television set without occupying a large area of space.

BRIEF DESCRIPTION OF THE DRAWINGS

The foregoing and other objects and advantages of the invention will become apparent with reference to the following detailed description of the preferred embodiment as illustrated by the drawings in which.

DETAILED DESCRIPTION OF THE FIGURES

Figure 1:
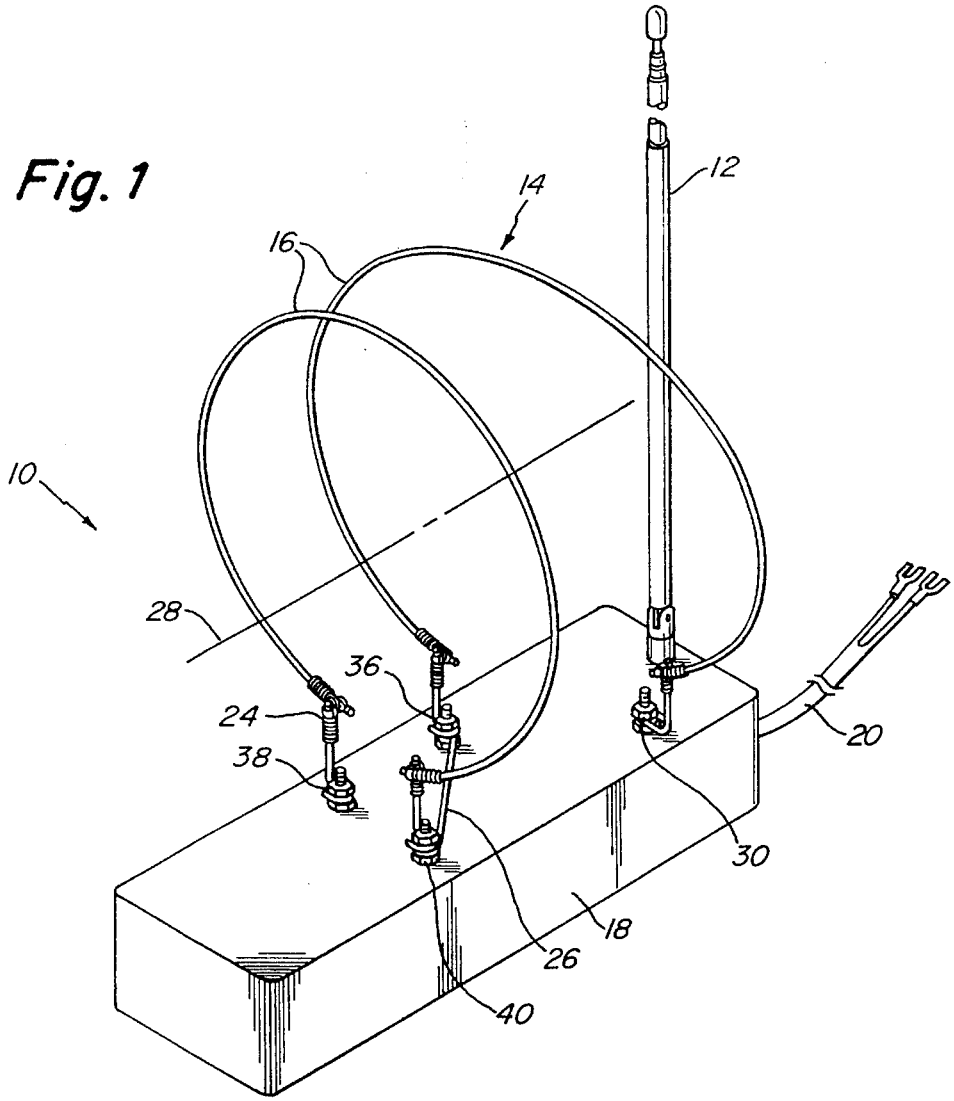
FIG. 1 is a perspective view of the preferred embodiment of the present invention.

FIG. 1 is a perspective view of an embodiment of the present invention. The present invention 10 includes a combination of a monopole telescoping rod 12 and a multi-turn helical antenna 14, mounted to a support structure 18. The multi-turn helical antenna element includes a plurality of loops 16 connected in series by coupling wire 26. The telescoping rod 12 and each turn 16 of the helical antenna 14 are rotatably mounted, by rotatable structures 22 and 24 respectively, to the support structure 18. The invention further includes a twin-lead transmission line 20 having a proximate end connected to the antenna 10 and a distal end to be connected to a TV receiver. An advantage of the present invention is that it is smaller in size than the prior art antennas.

Figure 2:
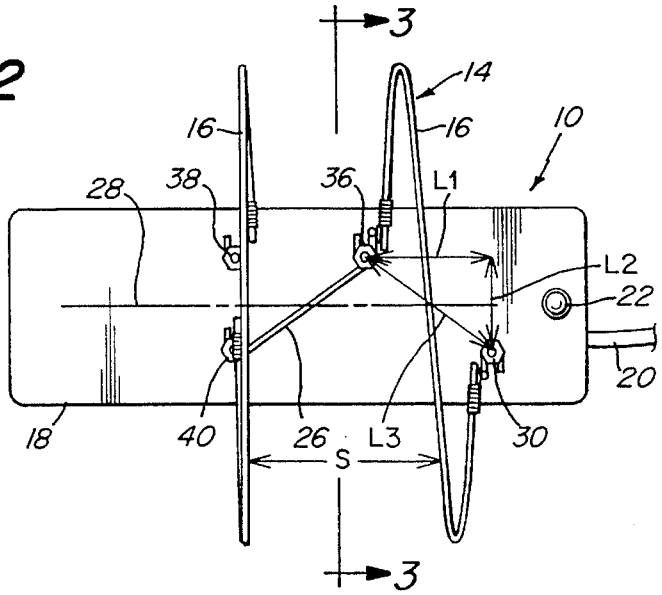
FIG. 2 is a more detailed top plan view of the preferred embodiment, in particular a helix element of the present invention.

Referring to FIG. 2, FIG. 2is a more detailed plan view of the helix element 14 of the antenna 10. In a preferred embodiment of the present invention, the helix is a two-turn helical antenna. Each turn 16 of the antenna is separated by a spacing 3 of 3". In the preferred embodiment, a first turn, proximate to the telescoping rod 12, of the helix is mounted to the supporting structure 8 at mounting terminals 30 and 36. Mounting structures 30 and 36 form a triangle having sides of L1 equal to 2 inches, L2 equal to 2 inches and L3 equal to 3 inches. A second-turn of the antenna is mounted to the supporting structure at mounting structures 38 and 40. Mounting structures 38 and 40 are separated by a distance equal to 2.0 inches. In addition, connections 38 and 36 are separated by a distance equal to 2 inches.

Mounting structure 22 of the telescoping rod 12 and mounting structure 24 of each turn 16 of the helix element 14 enable the telescoping rod and each turn of the helix to be rotated in both a horizontal plane, parallel to the support structure 18, and an elevation plane, perpendicular to the support structure 18. The telescoping rod can thus be rotated 360° in the horizontal plane and ±90° in the vertical plane. Further, each turn of the helix can be rotated ±90° in the horizontal plane and ±90° in the elevation plane.

Figure 3:
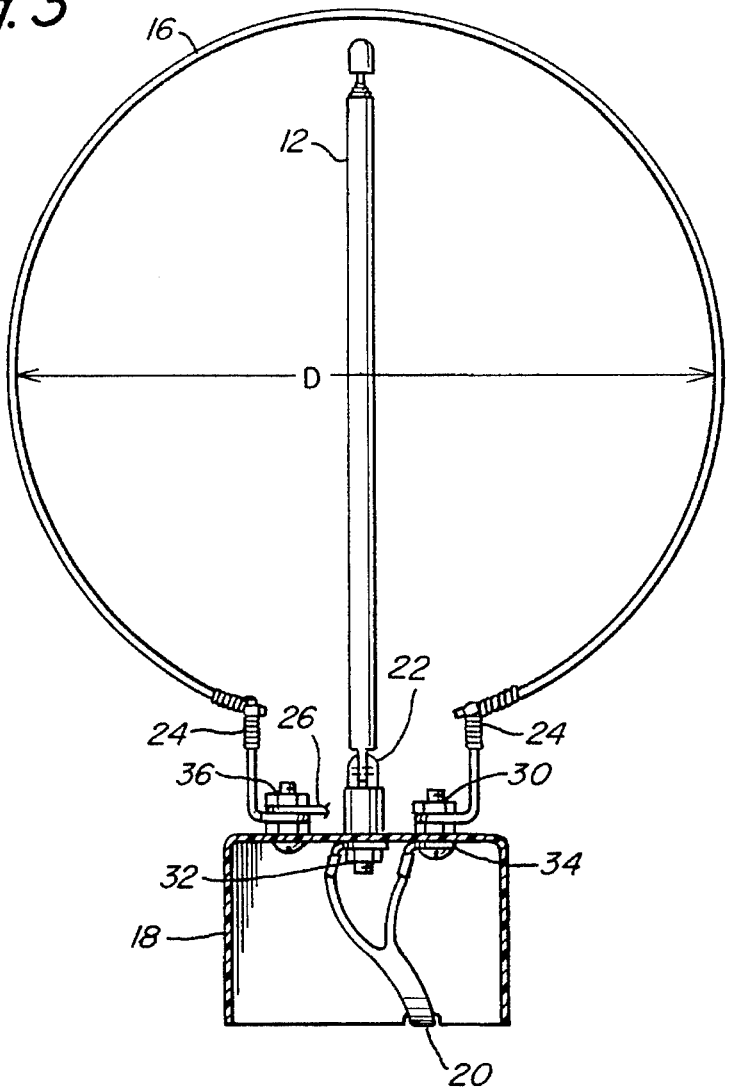
FIG. 3 is a cross sectional view of the present invention taken along the cutting line 3—3, as shown in FIG. 2.
Figure 4:
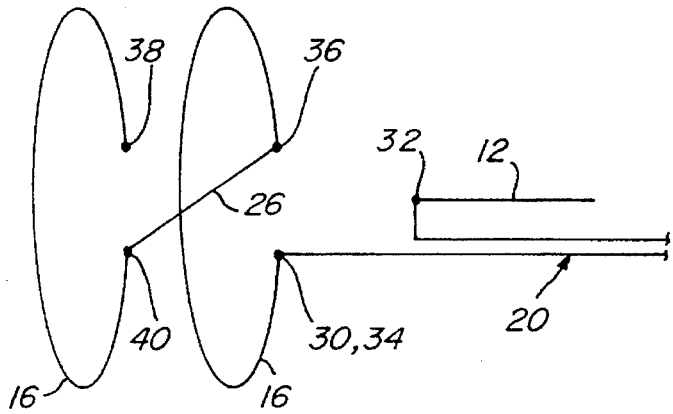
FIG. 4 is a schematic view of the present invention.

FIG. 3 is a cross sectional view taken along line 3—3 of FIG. 2. In the preferred embodiment of the invention a diameter D of each turn 16 of the helix 14 is 7.5 inches.

The helix 14 and the telescoping rod 12 of the antenna 10 are connected to the twin-lead transmission line 20 at connections 32 and 34. Connection 32 connects a first lead of the twin-lead to the telescoping rod monopole antenna. Connection 34 connects a second lead of the twin-lead transmission line 20 to the first connection point 30 of the helix antenna 14. Thus, with the present invention there is no need to switch between antenna impedances depending upon the frequency band of operation as is required by the prior antenna. Further, there is no need to impedance match the telescoping rod element or the helix antenna to the twin-lead transmission line via the use of a balun or any other matching network, as is sometimes required with the prior art antennas.

As is known in the prior art, a helical antenna can radiate in many modes. However, the axial mode of radiation is most commonly used. Referring to FIG. 1, the axial mode of radiation provides maximum radiation along the helix axis 28, and requires the helix circumference to be on the order of a wavelength. In contrast, a normal mode of operation yields a radiation pattern perpendicular to the helix axis 28, and requires the helix diameter to be small as compared to the wavelength of the frequency of operation. As discussed above, the prior art singular loop antenna is operated in the axial mode and thus has the problems of poor performance at the band edges.

In addition, the prior art circular loop antenna is limited to receiving horizontally polarized signals. A transmitted signal may be linearly, elliptically, and/or circularly polarized, as determined by the direction of the signal's electric field vector. The linear polarization used in communication systems is typically either vertical or horizontal. UHF, VHF, TV, and FM transmissions use a horizontal polarization.

A problem with being limited to reception of a horizontally polarized UHF, VHF electromagnetic wave, propagating through an ionized medium in the presence of a magnetic field such as that of the earth, is that the UHF, VHF signal undergoes a rotation in its plane of polarization. This so-called Faraday rotation causes the polarization of the transmitted UHF, VHF signal to rotate thereby causing reception fading with linearly polarized UHF, VHF antennas.

However, a receiving antenna, such as the dipole-helix antenna according to the present invention, which is capable of receiving circularly polarized signals (i.e., two orthogonal polarizations of energy), receives all types of linearly polarized signals equally well. Thus the reception fading of the transmitted UHF, VHF signal does not occur.

The helix antenna is normally a high-gain antenna where increasing the loops leads to an increased gain. However, a disadvantage of the helix is that the gain is achieved at the expense of bandwidth. Thus, an advantage of the combination of the monopole antenna element and the two-loop helix antenna element, of the present invention, is that it is an optimum compromise between gain, bandwidth and size.

Thus, with the present invention, the monopole telescoping rod is resonated by the multi-turn helical antenna and results in the helical antenna operating in both the normal mode and the axial mode of operation for receiving VHF and UHF TV signals, respectfully. Thus, with the present invention, the N-turn helix and the telescoping rod need not be adjusted, for each channel, in order to receive a TV signal with minimum "ghosting" of the channels. Further, operation of the present invention is less cumbersome than the prior art antennas.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. An antenna for receiving UHF and VHF frequency signals for use in connection with a television set, comprising:

a telescoping cylindrical monopole antenna element, rotatably mounted to a support structure to rotate freely 360° in a horizontal plane parallel to a longitudinal axis of the support structure and ±90° in a vertical plane which is perpendicular to the support structure, the monopole antenna element having s first port coupled to a first lead of a transmission line at a first end of the transmission line and wherein a second end of the transmission line is to be coupled to the television set; and a plurality of loop elements disposed in series to form an N-turn helix between a first port and a second port, each loop of the N-turn helix being rotatably mounted to the support structure such that each turn is rotatable ±90° in the horizontal plane and ±90° in the vertical plane, the first port of the N-turn helix being coupled to a second lead of the transmission line, whereby the N-turn helix operates in an axial mode and is circularly polarized to receive the UHF signals and operates in a normal mode and is circularly polarized to receive the VHF signals, the N-turn helix resonating the monopole antenna element to form a dipole antenna in the UHF and VHF frequency bands of operation.

2. The dipole antenna of claim 1, wherein the length of the telescoping cylindrical monopole antenna element is a quarter of a wavelength of the lowest frequency of operation.

3. The dipole antenna element of claim 1, wherein the N-turn helix is operated in both a normal mode and an axial mode of operation for receiving the UHF and VHF signals.

4. The dipole antenna element as claimed in claim 1, wherein the N-turn helix has an axial length of 4 inches.

5. The dipole antenna element of claim 1, wherein the helix contains two turns.

6. The dipole antenna element of claim 5, wherein the diameter of each turn of the helix is 7.5 inches.

7. The dipole antenna element of claim 6, wherein the spacing between the turns of the helix is 3 inches.

8. The dipole antenna of claim 1 wherein the N-turn helix antenna element is capable of adjustable spacing between turns of the helix to optimize performance, over the frequency band.

9. The dipole antenna of claim 2 wherein the helix contains 1 turns and the helix elements are able to rotate freely in the horizontal plane.

10. The dipole antenna of claim 2 wherein the helix contains 1 turns and the helix elements are able to rotate freely in the vertical plane.

11. The dipole antenna of claim 2 wherein the helix contains 1 turns and the helix elements are able to rotate freely in the horizontal and vertical plane.

12. An antenna apparatus for receiving UHF and VHF frequency signals for use in connection with a television set, comprising:

a telescoping monopole antenna element;

a base support structure having a longitudinal axis;

means for mounting the monopole antenna element to the support structure at a first end thereof to form a first port, the first port being coupled to a first lead of a transmission line;

said means for mounting said telescoping monopole antenna element including means for supporting the telescoping monopole antenna element so as to rotate freely in a horizontal plane parallel to the longitudinal axis and in a vertical plane perpendicular to the support structure;

a plurality of loop elements disposed in series to form an N-turn helix between a first port and a second port, the first port being coupled to a second lead of the transmission line;

means for supporting each loop of the N-turn helix to the support structure at a location spaced from said telescoping monopole antenna element in a direction toward a second end of the support structure;

said means for supporting said each loop of said N-turn helix including means for enabling the each loop to be rotated freely in both the horizontal plane and the vertical plane; and wherein the N-turn helix operates in an axial mode and is circularly polarized to receive VHF signals and operates in a normal mode and is circularly polarized to receive VHF signals, the N-turn helix resonating the monopole antenna element to form a dipole antenna.

* * * * *